US005332162A

United States Patent [19]

Peck, deceased et al.

[11] Patent Number: 5,332,162

[45] Date of Patent: Jul. 26, 1994

[54] ELECTROSTATIC SPRAY APPARATUS INCLUDING A SPRAY HOOD HAVING AN ELECTRODE

[76] Inventors: Arthur G. E. Peck, deceased, late of Hull, Great Britain; by Margaret Peck, legal representative, 3 Wood Drive, North Ferriby, North Humberside, Great Britain

[21] Appl. No.: 778,132

[22] PCT Filed: Jun. 6, 1990

[86] PCT No.: PCT/GB90/00877

§ 371 Date: Jan. 31, 1992

§ 102(e) Date: Jan. 31, 1992

[87] PCT Pub. No.: WO90/14894

PCT Pub. Date: Dec. 13, 1990

[30] Foreign Application Priority Data

Jun. 7, 1989 [GB] United Kingdom ..... 8913121.3

[51] Int. Cl.[5] ..... B05B 5/08

[52] U.S. Cl. ..... 239/690; 239/700; 118/629; 118/630; 118/DIG. 7

[58] Field of Search ..... 239/690, 697, 698, 700, 239/701, 703, 708; 118/627, 629, 630, 326, DIG. 7

[56] References Cited

U.S. PATENT DOCUMENTS

| | | | |
|---|---|---|---|
| 2,980,338 | 4/1961 | Kozinski | 239/697 |
| 4,836,137 | 6/1989 | Heine et al. | 118/630 |
| 4,901,666 | 2/1990 | Nagasaka et al. | 118/DIG. 7 |

FOREIGN PATENT DOCUMENTS

| | | | |
|---|---|---|---|
| 0186983 | 7/1986 | European Pat. Off. . | |
| WO88/03748 | 6/1988 | PCT Int'l Appl. . | |
| 2124517 | 2/1984 | United Kingdom | 239/700 |
| 2132917 | 7/1984 | United Kingdom | 239/690 |
| 2197601 | 5/1988 | United Kingdom . | |
| 88/08332 | 11/1988 | World Int. Prop. O. | 239/690 |

*Primary Examiner*—Karen B. Merritt

*Attorney, Agent, or Firm*—Scully, Scott, Murphy & Presser

[57] ABSTRACT

An electrostatic spray apparatus, including a spray hood having an electrode. The hood defines a top region with a depending skirt and comprises first and second hood elements, either or both of which may comprise molded shells, with an electrode sandwiched therebetween. The electrode extends over the top region and down the skirt and terminates short of the lower regions of the skirt. The hood is constructed such that, other than at the lowermost regions of the skirt, the hood does not have any junction of its planar surfaces having a radius less than one hundred and fifty millimeters. The hood has an opening in its top region, through which an electrostatic spray head is placed into the hood. The electrode presents a connection for an electrical supply, and the potential applied to the spray head is substantially the same as that applied to the electrode.

13 Claims, 1 Drawing Sheet

ELECTROSTATIC SPRAY APPARATUS INCLUDING A SPRAY HOOD HAVING AN ELECTRODE

This invention relates to electrostatic spray apparatus and, more particularly, to a spray hood for electrostatic spray apparatus.

It is well known in the art to discharge solids in particle, fibre and the like divided solids forms, and liquids in droplet form, all hereinafter called "spray particles," from a spray head and to apply a high voltage electrostatic charge to said spray particles to form a cloud falling onto a target at a lower potential than the spray particles. The spray apparatus may be static, whereupon the target to be sprayed may be static or traversed beneath the spray head, or the apparatus may be mobile, whereupon the apparatus is traversed over the target.

The falling charged particles are very susceptible to displacement by air currents and uncontrollable air currents can adversely affect the deposition pattern of the spray particles on the target.

When the spray head and the target are static it is the practice to carry out the spray operation in a closed spray booth. In all other applications it is necessary to shield at least the upper regions of the spray cloud against uncontrollable air currents and the practise is to mount the spray head in the upper regions of a hood, the lower regions of which are open to the target.

In more recent times it has been proposed that the electrostatic spray particles be focussed by passing through an electrical field, generated by an electrode between the spray head and the target.

Such an arrangement, intended to apply electrostatically charged spray particles to crops on a conveyor passing beneath the spray head, is disclosed in, for example, British Patent Application No. 8727184 (Publication No. 2197601) and wherein electrostatically charged spray particles are released within a hood and an electrode, wound around the inside of the hood and supported by internal ribs of the hood, establishes a focussing electrical field through which the charged particles fall.

The present invention seeks to provide a hood for an electrostatic spray apparatus, which is more efficacious than spray hoods proposed by the prior art, and an electrostatic spray apparatus including such a hood.

According to the present invention there is provided a a spray hood, for an electrostatic spray apparatus, comprising a first hood element defining a top region with a downwardly depending skirt and an electrode supported within said first hood element, characterized in that the hood includes a second hood element within the first element, the electrode is sandwiched between said first and said second hood elements and extends across the top region and down the greater part of said skirt, and the composite hood does not have any junction of its planar surfaces, other than at the lowermost regions of the said skirt, having a radius of less than one hundred and fifty millimeters throughout its construction.

Spray hoods proposed in the past have included junctions between plane surfaces defining sharp comers, or minimally radiused junctions, and the present invention recognises that such sharp junctions create adverse conditions in the electrode-generated electrical field at and adjacent such junctions.

In one preferred embodiment the spray hood is characterised in that the electrode is in the form of a metallic film.

In another embodiment the electrode is in the form of a mesh.

In a preferred embodiment said first hood element is defined by a moulded shell, the electrode is applied to the internal surface of said moulded shell and the second hood element comprises a lining applied to cover, support and maintain the electrode within the moulded shell.

With such an arrangement the second hood lining element is conveniently applied to the first hood element by a spray process.

In another embodiment the second hood element comprises a moulded shell and said second hood element shell is a neat fit within the said first hood element.

Preferably the first and second hood elements are bonded together along the lower edge regions of the skirt defined by the composite hood structure.

Preferably the first and second hood elements each comprise an electrically insulating plastics material.

The invention also envisages an electrostatic spray apparatus comprising a high voltage electrostatic spray head mounted in the upper regions of a hood constructed in accordance with the invention.

In a preferred embodiment the spray head comprises a spinning disc arrangement, entered into the hood through an opening in the top region of the hood.

Preferably, the electrode has a single connection for attachment to a high voltage electrical source and said connection extends from the electrode through the outer shell of the hood adjacent to, but spaced from, the opening through which the spray head is entered into the hood.

When the electrostatic spray head comprises a spinning disc distributing a liquid the droplet size can be less than 100 micrometers and the spray pattern falling onto the target is generally in the form of an annulus. By providing a hood according to the present invention the small droplets forming the cloud of falling charged spray particles can advantageously be redistributed by the electrical field generated by the electrode to afford a more uniform deposition on the target.

Preferably the electrostatic spray head is connectable to a high voltage source in the range of 15 kilovolts to 30 kilovolts, more preferably in the range of 20 kilovolts to 30 kilovolts, at between 10 to 20 micro amperes.

In a preferred embodiment the potential applied to the electrode is substantially the same as that applied to the spray head.

Whilst the hood may have a generally circular configuration the present invention envisages rectangular spray-hoods, wherein the skirt comprises four side walls, connected at their junctions by arcuate wall sections each having a radius of not less than one hundred and fifty millimeters.

The invention will now be described further by way of example with reference to the accompanying drawings in which.

Figure 1:
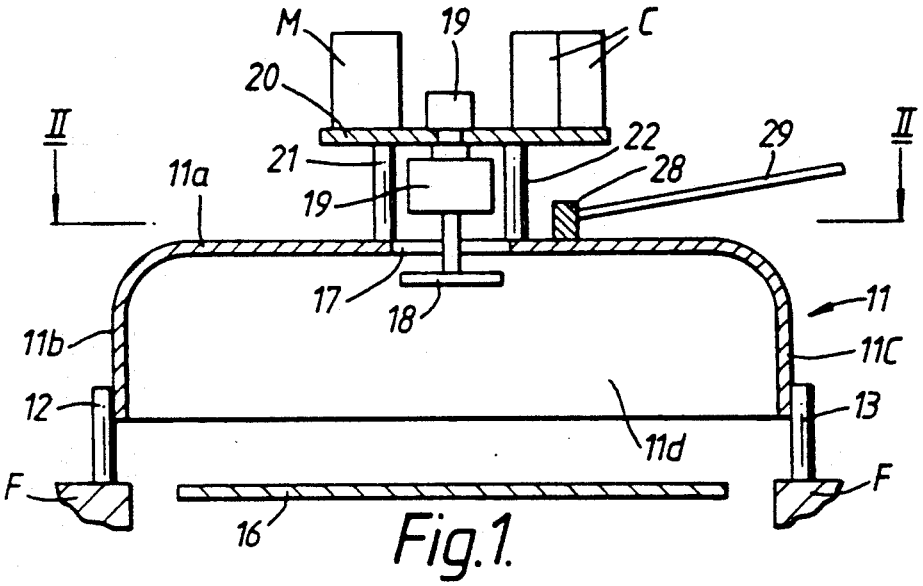
FIG. 1 shows a vertical cross section through a spray apparatus in accordance with the invention on the line I—I in FIG. 2.
Figure 2:
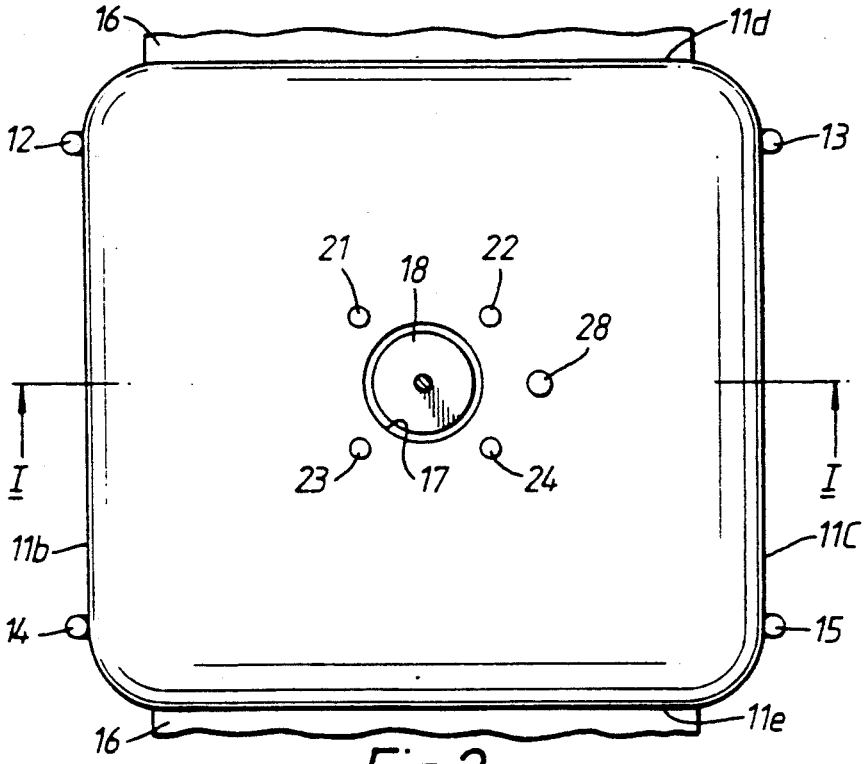
FIG. 2 shows a plan view of the apparatus illustrated in FIG. 1 on the line II—II in FIG. 1.

In the example illustrated in FIGS. 1 and 2 a hood 11 is supported on insulating elements 12, 13, 14 and 15, secured to a machine frame F, above a conveying element 16. The hood comprises a substantially flat top portion 11*a* with a depending skirt comprising side walls 11*b*, 11*c*, 11*d* and 11*e*. The top 11*a* includes an aperture 17, substantially centrally thereof, through which the spinning disc 18 of a spray apparatus, generally indicated by reference numeral 19, is entered into the hood. The spray apparatus 19 is a high voltage electrostatic spray apparatus mounted on an insulating plate 20 supported on insulating pillars 21, 22, 23 and 24 upstanding from the top 11*a* of the hood 11.

The insulating plate 20 my also support the metering unit M for the spray apparatus and the container or containers C constituting the reservoir(s) for material to be sprayed.

The spray disc 18 may be of any conventional form but is most preferably of the form described in the Applicants copending British Patent Application No. 88270442 (Publication WO-A-90/05592).

The spray apparatus 18, 19 is connected to a high voltage source, conveniently to a source delivering between 5 to 30 kilovolts, more preferably between 20 and 30 kilovolts, at between 10 and 20 micro amperes, conveniently 16 micro amperes, so that spray particles distributed therefrom have a high electrostatic charge applied thereto.

The conveying element 16 can have any desired fore and may, for example, comprise the upper run of a conveying band but when the articles have a generally globular configuration, such as potatoes, said conveying element 16 conveniently comprises a roller conveyor run which causes the articles to roll as they pass beneath the hood, thus to apply spray particles over the whole of the respective surface areas of said articles.

Figure 3:
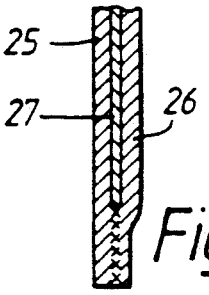
FIG. 3 shows a cross section through part of the skirt, for one hood construction.

The hood 11 is a composite hood and, in the FIG. 3, construction, comprises a moulded outer shell 25, a moulded inner shell 26 and an electrode 27 sandwiched between the moulded shells 25 and 26.

The electrode 27 extends from the aperture 17 across the top 11*a* and down the skirt defined by side walls 11*b*, 11*c* 11*d* and 11*e* to terminate short of the lower regions of the shells 25 and 26. Below the lower edge of the electrode 27 the shells 25 and 26 are welded together by a deep weld and an electrical connection 28 from the electrode 27 passes through the outer shell 25 to an electrical connection 29 at the top 11*a* of the shell 11, adjacent the aperture 17.

The connection 29 is connected to the same high voltage source as the spray head 18, 19.

The shells 25 and 26 may conveniently be made from an electrically insulating plastics material, such as polyethylene, by a vacuum forming process.

Figure 4:
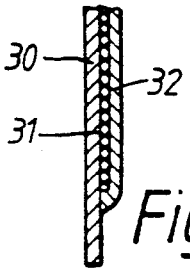
FIG. 4 shows a cross-section through part of the skirt for a second embodiment hood according to the invention.

The hood 11 embodiment illustrated in FIG. 4 is also of composite construction and comprises a moulded outer shell 30, conveniently made from an electrically insulating plastics material, with a sheet electrode 31 applied to its internal surfaces. The electrode 31 may be applied to the inner surface of the moulded shell 30 by a spraying or the like deposition process, or said electrode 31 may comprise a mesh structure adhering to the moulded shell 30.

In the event the electrode 31 terminates short of the lowermost regions of the skirt defined by the moulded shell 30.

The electrode 31 is retained with the moulded shell 30 by a layer 32 of an electrical insulating material and which layer 32 may comprise strips of flexible resin-soaked material applied over the electrode 31 and to the exposed lower skirt regions of the moulded shell 30, to build up a continuing layer 32 lining the internal surfaces of the moulded shell 30. When the electrode 31 is a mesh the layer material will extend through the apertures in the mesh and into contact with the moulded shell 30 to increase the bonding of the layer 32 with the moulded shell 30.

As stated hereinbefore the spray patterns normally produced by spinning discs are annular in form and, when the spray pattern falls onto articles distributed over the width direction of the conveying element 16, the deposition along the side edges is far heavier than at the mid-regions of the element 16. By providing a hood 11 of the type according to the invention the charged particles falling through the electrical field generated by the electrode 27 or 31 are redistributed by said field, whereupon the distribution to the target is far more uniform than can be obtained with hoods known in the art.

I claim:

1. A spray hood, for an electrostatic spray apparatus, comprising a first hood element having substantially planar surfaces defining a top region with a downwardly depending skirt, which extends downwardly a given distance, and an electrode supported within said first hood element, characterized in that the hood includes a second hood element within the first hood element, the electrode is sandwiched between said first and said second hood elements and extends across the top region and extends downwardly for more than half of said given distance, and the spray hood does not have any junction of its planar surfaces, other than at the lowermost regions of said skirt, having a radius of less than one hundred and fifty millimeters throughout its construction.

2. A spray hood according to claim 1, characterised in that the electrode is in the form of a metallic film.

3. A spray hood according to claim 1, characterised in that the electrode is in the form of a mesh.

4. A spray hood according to claim 1, characterised in that said first hood element is defined by a moulded shell, the electrode is applied to an internal surface of said moulded shell and the second hood element comprises a lining applied to cover, support and maintain the electrode within the moulded shell.

5. A spray hood according to claim 4 characterised in that the lining of the second hood element is applied to the first hood element by a spray process.

6. A spray hood according to claim 1, characterised in that the second hood element comprises a moulded shell and said second hood element shell is a neat fit within the said first hood element.

7. A spray hood according to claim 4 or 6, characterised in that the two moulded shells are bonded together along the lower edge regions of the skirt defined by the composite moulded shells structure.

8. A spray hood according to claim 4, 5, or 6 characterised in that the first and second hood elements each comprise an electrically insulating plastics material, 9. A spray hood as claimed in claim 1 in combination with an electrostatic spray apparatus comprising a high voltage electrostatic spray head mounted in the upper regions of a hood.

10. An electrostatic spray apparatus according to claim 9, characterised in that the spray head comprises a spinning disc arrangement, entered into the hood through an opening in the top region of the hood.

11. An electrostatic spray apparatus according to claim 9, characterised in that the electrostatic spray head is connected to a high voltage source in the range of 15 kilovolts to 30 kilovolts, at between 10 to 20 micro amperes.

12. An electrostatic spray hood according to claim 9, 10 or 11, characterised in that the potential applied to the electrode is substantially the same as that applied to the spray head.

13. An electrostatic spray hood according to claim 11, wherein said high voltage source is in the range of 20 kilovolts to 30 kilovolts.

* * * * *